US006663363B2

(12) United States Patent
Lee et al.

(10) Patent No.: US 6,663,363 B2
(45) Date of Patent: Dec. 16, 2003

(54) DRIVING PIN STRUCTURE FOR SCROLL COMPRESSOR

(75) Inventors: Dong Soo Lee, Seongnam (KR); In Hwe Koo, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/042,205

(22) Filed: Jan. 11, 2002

(65) Prior Publication Data

US 2003/0039569 A1 Feb. 27, 2003

(30) Foreign Application Priority Data

Aug. 27, 2001 (KR) ..... 2001/51856

(51) Int. Cl.[7] ..... F01C 1/02
(52) U.S. Cl. ..... 418/55.1; 418/55.5; 418/57
(58) Field of Search ..... 418/55.1, 55.5, 418/57

(56) References Cited

U.S. PATENT DOCUMENTS 5,370,512 A * 12/1994 Fujitani et al. ..... 418/55.2
5,547,355 A * 8/1996 Watanabe et al. ..... 418/55.5
6,053,714 A * 4/2000 Fenocchi et al. ..... 418/55.1
6,386,847 B1 * 5/2002 Bush et al. ..... 418/55.5

FOREIGN PATENT DOCUMENTS

JP 03105001 A * 5/1991 ..... F01C/1/02
JP 05125901 A * 5/1993 ..... F01C/1/02
JP 06010872 A * 1/1994 ..... F04C/29/02

* cited by examiner

*Primary Examiner*—Thomas Denion
*Assistant Examiner*—Theresa Trieu
(74) *Attorney, Agent, or Firm*—Birch, Stewart, Kolasch & Birch, LLP

(57) ABSTRACT

In a scroll compressor, in order to provide a structure of a driving pin for a scroll compressor which is capable of transmitting a rotational force by being combined with a rotating scroll, in a scroll compressor comprising a fixed scroll having a wrap, a rotating scroll having a wrap engaged with the wrap of the fixed scroll and performing a rotational motion in a radial direction of the rotational axis of a driving device, a driving pin eccentrically formed at the rotational axis of the driving device and inserted into a boss of the rotating scroll and a bush member interposed between the boss of the rotating scroll and the driving pin, the driving pin has a length shorter than a length of the bush member. Accordingly, it is possible to prevent a damage of a driving pin due to a stress concentration by reducing a bending moment of the driving pin.

5 Claims, 5 Drawing Sheets

FIG. 4
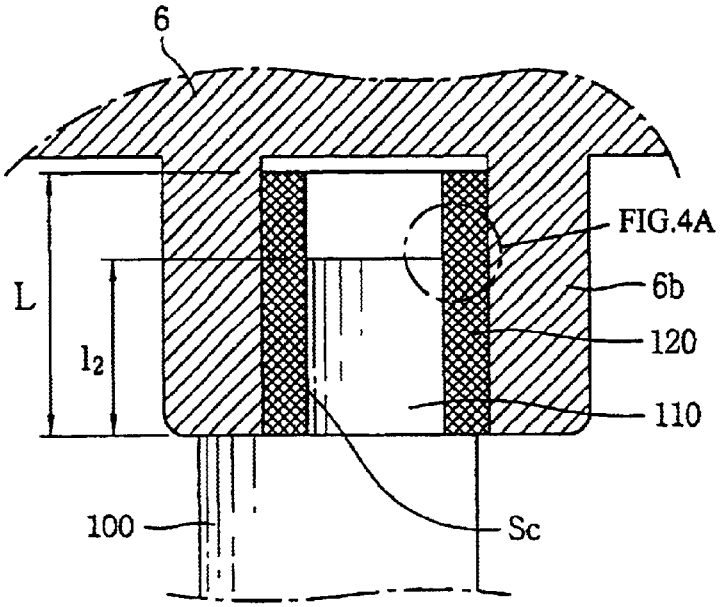
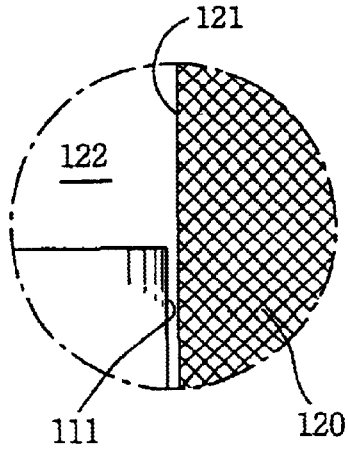
FIG. 4A
FIG. 5
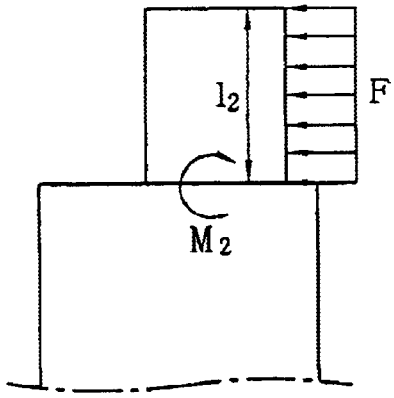

FIG. 6
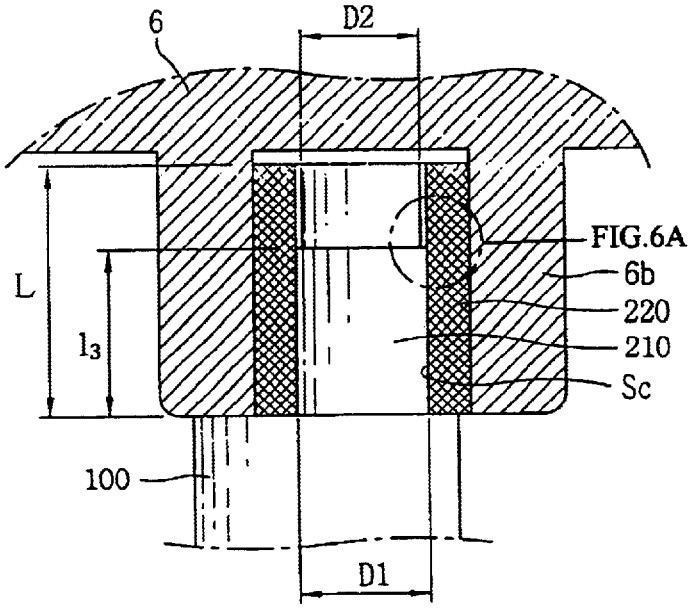
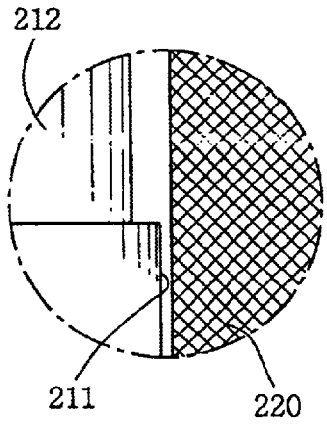
FIG. 6A
FIG. 7
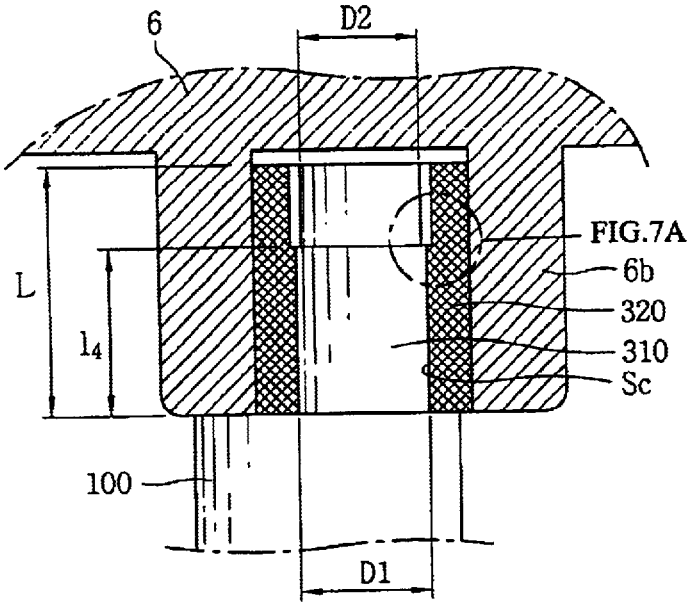
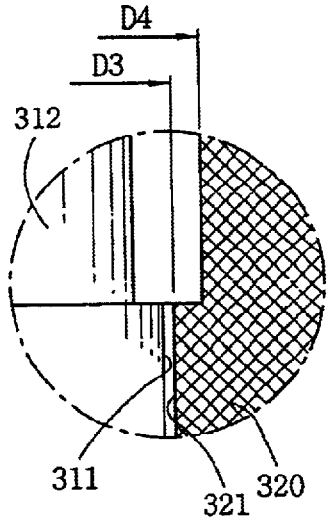
FIG. 7A

FIG. 8
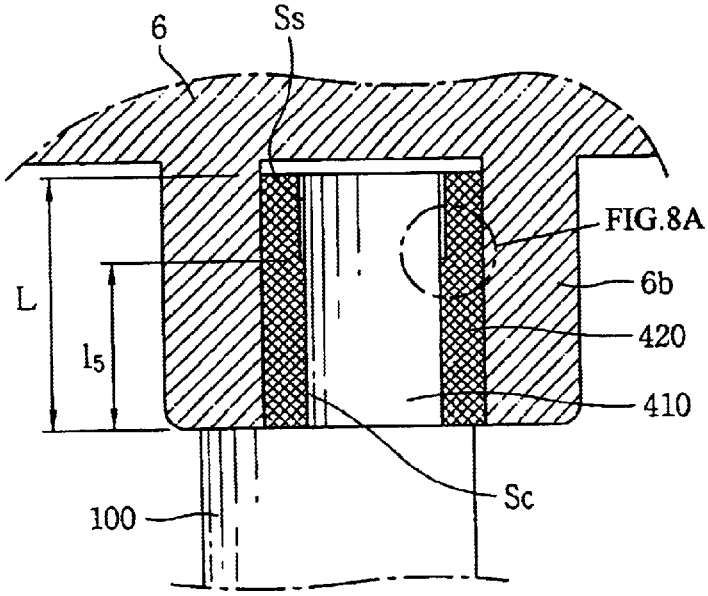
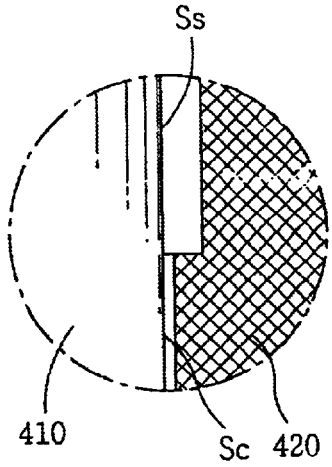
FIG. 8A

DRIVING PIN STRUCTURE FOR SCROLL COMPRESSOR

BACKGROUND OF THE INVENTION

1. Field of the Invention

The present invention relates to a scroll compressor, and in particular to a structure of a driving pin for a scroll compressor which is capable of transmitting a rotational force by being combined with a rotating scroll.

2. Description of the Background Art

Generally, a compressor is for compressing a compressible fluid by using mechanical energy and can be divided into a reciprocating type, a scroll type, centrifugal type and a vane type, etc.

Unlike a reciprocating type compressor using a linear motion of a piston, a scroll type compressor (hereinafter, it is referred to as a scroll compressor) sucks, compresses and discharges gas by using a rotational body similar to a centrifugal type compressor and a vane type compressor.

FIG. 1 is a longitudinal sectional view illustrating the conventional scroll compressor.

As depicted in FIG. 1, the conventional scroll compressor includes a casing 1 filled with oil up to a certain height, a main frame 2 and a sub frame 3 respectively fixed to the upper and the lower portions of the inner circumference of the casing 1, a driving motor 4 installed between the main frame 2 and the sub frame 3 and having a stator 4A and a rotor 4B, a rotational axis 5 placed so as to fit for the center of the rotor 4B of the driving motor 4 and penetrating through the main frame 2, a rotating scroll 6 combined with the rotational axis 5 and installed to the upper surface of the main frame 2, a fixed scroll 7 fixed to the upper surface of the main frame 2 so as to form a plurality of compressing chambers by being coupled to the rotating scroll 6, a high/low pressure division plate 8 installed to the upper portion of the fixed scroll 7 and dividing the inner space of the casing 1 into a suction pressure region and a discharge pressure region, and a counterflow prevention valve assembly 9 combined with the upper surface of the high/low pressure division plate 8 and preventing a counterflow of discharged gas.

FIG. 2 is a longitudinal sectional view illustrating a shape and an assembly state of a slide bush and a driving pin of the conventional scroll compressor.

As depicted in FIG. 2, in the rotational axis 5, a driving pin 5*a* eccentrically projects from the upper end of the rotational axis 5 in order to rotate the rotating scroll 6, and a slide bush 10 inserted into the boss 6*b* of the rotating scroll 6 is slides over the driving pin 5*a* inserted therein.

In addition, a sliding hole 10*a* having a guide surface (not shown) is formed at the inner circumference of the slide bush 10. The sliding hole 10*a* is a relatively deep hole in order to permit a sliding-contact between a sliding surface (not shown) of the driving pin 5*a* and the sliding hole 10*a*.

In FIGS. 1 and 2, reference numeral 6*a* is a wrap of the rotating scroll 6, reference numeral 7*a* is a wrap of the fixed scroll 7, and reference numeral DP is a discharge pipe.

The operation of the conventional scroll compressor will be described hereinafter.

When power is applied, the rotor 4B rotates beside the stator 4A together with the rotational axis 5, and the driving pin 5*a* formed at the upper portion of the rotational axis 5 eccentrically rotates together. The rotating scroll 6 connected to the driving pin 5*a* rotates by the eccentric rotation of the driving pin 5*a* over an eccentric distance. A body capacity of the plurality of compressing chambers formed by the wraps 6*a*, 7*a* of the rotating scroll 6 and the fixed scroll 7 is decreased while being moved to the center portion by the continuous rotational motion of the rotating scroll 6 Accordingly, refrigerant gas is sucked, compressed and discharged by the compressor.

FIG. 3 is a perspective view illustrating a load distribution of the driving pin of the conventional scroll compressor.

However, in the conventional scroll compressor, the rotational force of the driving motor 4 is transmitted to the rotating scroll 6 by the driving pin 5*a* engaging the slide bush 10. As depicted in FIG. 3, because the side surface of the driving pin 5*a* contacting the slide bush 10 receives a reactive force, a bending moment M1 according to this contact acts on the driving pin 5*a*. Particularly, by the force and the moment acting on the side surface of the driving pin 5*a*, a stress acts on each surface of the driving pin 5*a*. The stress is especially concentrated on the start portion of the driving pin 5*a*, accordingly the driving pin 5*a* may be damaged due to the stress concentration when the scroll compressor is used for a long time.

SUMMARY OF THE INVENTION

In order to solve the above-mentioned problem, it is an object of the present invention to provide a driving pin structure for a scroll compressor which is capable of preventing a damage of a driving pin due to a stress concentration from happening by reducing a bending moment acted on the driving pin of a rotational axis.

In order to achieve the object of the present invention, in a scroll compressor comprising a fixed scroll having a wrap, a rotating scroll having a wrap engaged with the wrap of the fixed scroll and performing a rotational motion in a radial direction of the rotational axis of a driving device, a driving pin eccentrically formed at the rotational axis of the driving device and inserted into a boss of the rotating scroll and a bush member interposed between the boss of the rotating scroll and the driving pin, the driving pin has a length shorter than a length of the bush member.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 4 is a longitudinal sectional view illustrating a shape and an assembly state of a slide bush and a driving pin of a scroll compressor in accordance with a first embodiment of the present invention;

FIG. 4A is a detail of the portion within the circle of FIG. 4;

FIG. 5 is a perspective view illustrating a load distribution of the driving pin of the scroll compressor in accordance with the first embodiment of the present invention;

FIG. 6 is a longitudinal sectional view illustrating a shape and an assembly state of a slide bush and a driving pin of a scroll compressor in accordance with a second embodiment of the present invention;

FIG. 6A is a detail of the portion within the circle of FIG. 6;

FIG. 7 is a longitudinal sectional view illustrating variation of a driving pin structure of the scroll compressor in accordance with the second embodiment of the present invention;

FIG. 7A is a detail of the portion within the circle of FIG. 7;

FIG. 8 is a longitudinal sectional view illustrating a shape and an assembly state of a slide bush and a driving pin of a scroll compressor in accordance with a third embodiment of the present invention; and FIG. 8A is a detail of the portion within the circle of FIG. 8.

DETAILED DESCRIPTION OF THE PREFERRED EMBODIMENTS

Figure 1:
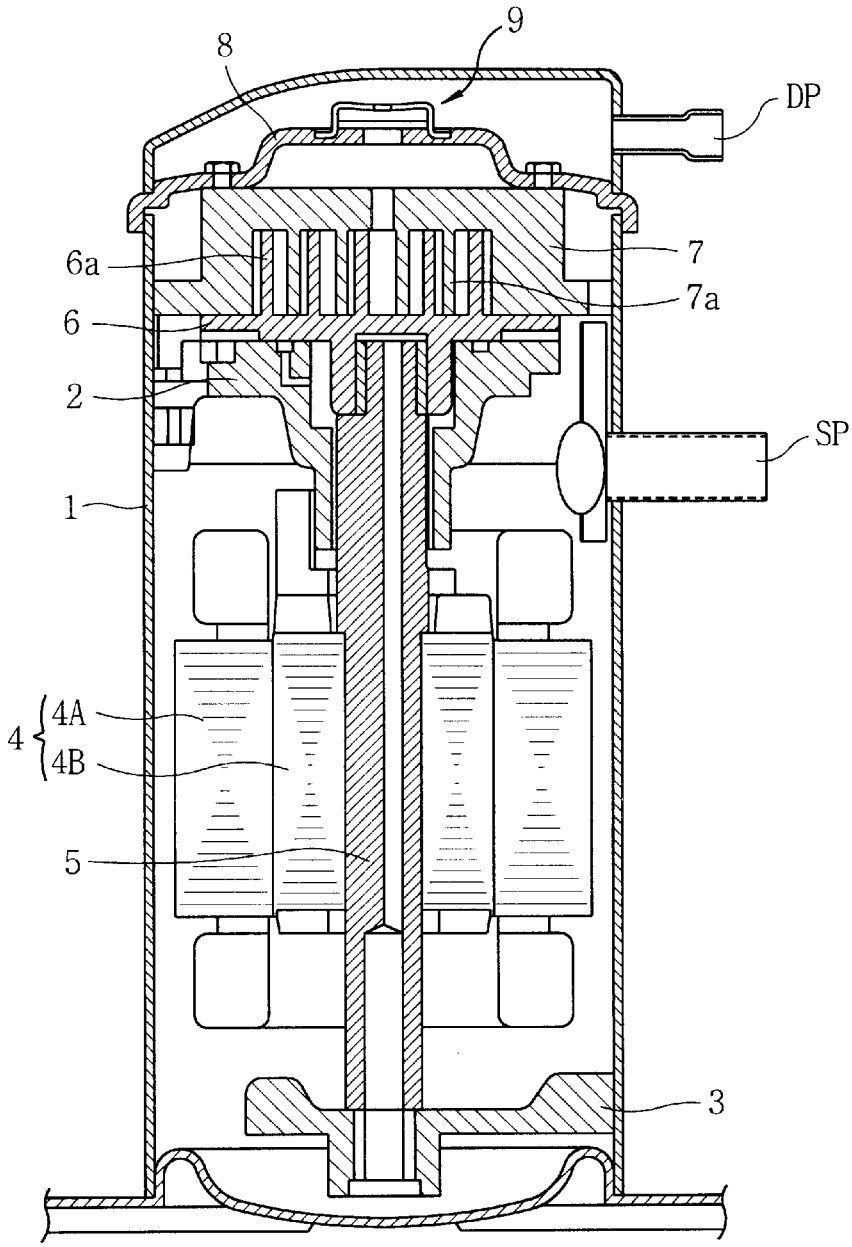
FIG. 1 CONVENTIONAL ART
FIG. 1 is a longitudinal sectional view illustrating the conventional scroll compressor.
Figure 2:
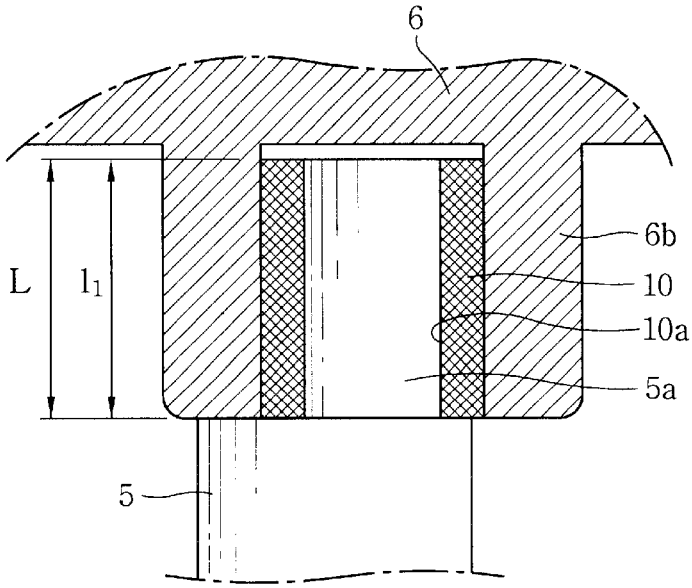
FIG. 2 CONVENTIONAL ART
FIG. 2 is a longitudinal sectional view illustrating a shape and an assembly state of a slide bush and a driving pin of the conventional scroll compressor.
Figure 3:
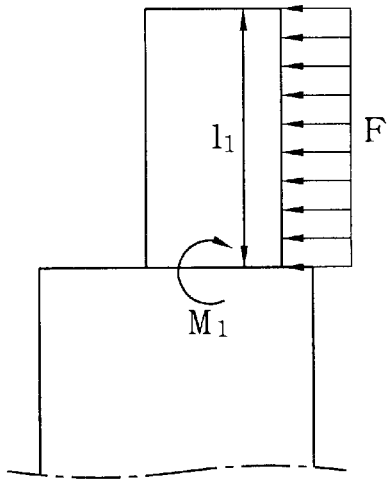
FIG. 3 CONVENTIONAL ART
FIG. 3 is a perspective view illustrating a load distribution of the driving pin of the conventional scroll compressor.

Hereinafter, a driving pin structure for a scroll compressor in accordance with the present invention will be described in detail with reference to accompanying drawings.

FIG. 4 is a longitudinal sectional view illustrating a shape and an assembly state of a slide bush and a driving pin of a scroll compressor in accordance with a first embodiment of the present invention, and FIG. 5 is a perspective view illustrating a load distribution of the driving pin of the scroll compressor in accordance with the first embodiment of the present.

As depicted in FIG. 4, in a driving pin structure for a scroll compressor in accordance with a first embodiment of the present invention, a slide bush 120 is interposed in a boss 6*b* of a rotating scroll 6 forming a compressing chamber by being coupled to a fixed scroll (not shown), a driving pin 110 along a rotational axis 100 is inserted into the boss 6*b* of the rotating scroll 6. However, a length of the driving pin 110 is shorter than a length of the slide bush (or an eccentric bush) 120.

In more detail, the driving pin 110 eccentrically formed at the upper end of the rotational axis 100 is inserted into the boss 6*b* of the rotating scroll 6 in order to rotate the rotating scroll 6. The outer circumference 111 of the driving pin 110 is operatively engaged in sliding contact with the inner circumference 121 of the slide bush 120.

A sliding hole 122 is formed at the slide bush 120 so as to permit the driving pin 110 to be inserted therein. The inner circumference of the sliding hole 122 is slide-contacted with the outer circumference of the driving pin 110.

The same reference numerals will be given to the same parts as the conventional art.

The operation effect of the driving pin structure for the scroll compressor in accordance with the first embodiment of the present invention will be described.

When the rotational axis 100 is rotated by the operation of a driving motor (not shown), the rotating scroll 6 eccentrically combined with the rotational axis 100 performs a rotational motion in a certain orbit. A body capacity of the plurality of compressing chambers (not shown) formed between the rotating scroll 6 and a fixed scroll (not shown) is decreased while moving consecutively to the center of the rotational motion, accordingly a refrigerant is sucked, compressed and discharged by the compressor.

Herein, the rotational force of the driving motor (not shown) is transmitted to the slide bush 120 through the driving pin 110 of the rotational axis 100, the rotational force transmitted to the slide bush 120 is transmitted to the boss 6*b* of the rotating scroll 6, accordingly the rotating scroll 6 turns centering around the driving pin 110.

Herein, as depicted in FIG. 5, because a length ($l_2$) of the driving pin 110 is shorter than a length (L) of the slide bush 120, a length of a contact portion (Sc) at which the slide bush 120 is contacted is shorter. Therefore, bending moment (M) occurred by a force (F) acting on the driving pin 110 is decreased and a stress concentration on the driving pin 110 can be effectively reduced. In more detail, the force acting on the driving pin 110 is equal, but a length ($l_2$) of the contact portion (Sc) of the driving pin 110 is relatively short and a bending moment (M2) is decreased. Accordingly, the stress acting on the section of the driving pin 110 is reduced.

FIG. 6 is a longitudinal sectional view illustrating a shape and an assembly state of a slide bush and a driving pin of a scroll compressor in accordance with a second embodiment of the present invention, FIG. 7 is a longitudinal sectional view illustrating variation of a driving pin structure of the scroll compressor in accordance with the second embodiment of the present invention, and FIG. 8 is a longitudinal sectional view illustrating a shape and an assembly state of a slide bush and a driving pin of a scroll compressor in accordance with a third embodiment of the present invention.

In the meantime, similar to the driving pin structure for the scroll compressor in accordance with the first embodiment of the present invention, by reducing a contact portion of a slide bush 220 and a driving pin 210 in a driving pin structure for a scroll compressor in accordance with a second embodiment of the present invention, a stress on the driving pin 210 can be reduced. Accordingly, a damage of the driving pin 210 due to the stress concentration can be reduced.

In more detail, as depicted in FIG. 6, in the driving pin structure for the scroll compressor in accordance with the second embodiment of the present invention, an extended portion 212 having a diameter (D2) smaller than a diameter (D1) of the driving pin 210 is formed extending from the upper end portion of the driving pin 210. Unlike the driving pin structure in accordance with the first embodiment of the present invention, driving pin 210 is provided with the extended portion 212. However, a length ($l_3$) of a contact portion (Sc) at which the driving pin 210 and the slide bush 220 are contacted is shorter, a bending moment acting on the driving pin 210 is decreased, and a stress concentration on the driving pin 210 can be effectively reduced.

In addition, as depicted in FIG. 7, as a variation of the driving pin structure for the scroll compressor in accordance with the second embodiment of the present invention, the inner diameter D4 of the inner circumference 322 of a slide bush 320 corresponding to an extended portion 312 formed at the upper end of the driving pin 310 is larger than the inner diameter D3 of the slide bush 320 corresponding to the driving pin 310. In that case, a length of a contact portion (Sc) of the driving pin 310 and the slide bush 320 is shorter, a bending moment acting on the driving pin 310 is decreased, and a stress concentration on the driving pin 310 can be effectively reduced.

In FIG. 8, in a driving pin structure for a scroll compressor in accordance with a third embodiment of the present invention, a non-contact portion (Sc), e.g., not contacting a slide bush 420 is formed at the end of the driving pin 410. Since a contact portion (Sc) of the driving pin 410 and the slide bush 420 is decreased, a bending moment acting on the driving pin 410 is reduced and a stress concentration on the driving pin 410 can be effectively reduced.

What is claimed is:

1. A driving pin structure for a scroll compressor, said driving pin structure comprising:

a fixed scroll having a wrap;

a rotating scroll having a wrap being engaged with the wrap of the fixed scroll and performing a rotational motion in a radial direction of a rotational axis;

a driving pin eccentrically formed along the rotational axis of a driving device and being operatively inserted into a boss of the rotating scroll;

a bush member interposed between the boss of the rotating scroll and the driving pin, wherein the driving pin has a length shorter than a length of the bush member; and an extended portion extending from an end of the driving pin, wherein the extended portion has a diameter smaller than a diameter of the driving pin.

2. The driving pin structure according to claim 1, wherein an inner diameter of the bush member corresponding to the extended portion is larger than an inner diameter of the bush member at a section corresponding to the driving pin.

3. A driving pin structure for a scroll compressor comprising:

a fixed scroll having a wrap;

a rotating scroll having a wrap being engaged with the wrap of the fixed scroll and performing a rotational motion in a radial direction of a rotational axis;

a driving pin eccentrically formed along the rotational axis of a driving device and being operatively inserted into a boss of the rotating scroll, said driving pin having an outer circumference;

a bush member interposed between the boss of the rotating scroll and the driving pin, said bush member having an inner circumference and a length equal to a length of said driving pin;

a recessed portion formed on said bush member, wherein at least a portion of said inner circumference of said bush member and a portion of said outer circumference of said driving pin are recessed with respect to each other and said recessed portion prevents operative contact between said driving pin and said bush member.

4. A scroll compressor comprising:

a rotating shaft;

a fixed scroll having a wrap;

a rotating scroll having a wrap being engaged with the wrap of the fixed scroll and performing a rotational motion in a radial direction of a rotational axis;

a driving pin eccentrically formed along the rotational axis of a driving device and being operatively inserted into a boss of the rotating scroll;

a bush member interposed between the boss of the rotating scroll and the driving pin; wherein the driving pin has a length shorter than a length of the bush member, and an extended portion extending from an end of the driving pin, wherein the extended portion has a diameter smaller than a diameter of the driving pin.

5. The scroll compressor according to claim 4, wherein an inner diameter of the bush member corresponding to the extended portion is larger than an inner diameter of the bush member at a section corresponding to the driving pin.

* * * * *